US009851660B2

(12) United States Patent
Noguchi et al.

(10) Patent No.: US 9,851,660 B2
(45) Date of Patent: Dec. 26, 2017

(54) IMAGE FORMING APPARATUS WITH CONTROLLED SEPARATION VOLTAGE AND TRANSFER VOLTAGE

(71) Applicant: Konica Minolta, Inc., Chiyoda-ku, Tokyo (JP)

(72) Inventors: Hidetoshi Noguchi, Tahara (JP); Satoru Shibuya, Chiryu (JP); Kazuyoshi Hara, Itami (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 92 days.

(21) Appl. No.: 14/947,214

(22) Filed: Nov. 20, 2015

(65) Prior Publication Data

US 2016/0077470 A1 Mar. 17, 2016

Related U.S. Application Data

(62) Division of application No. 13/050,037, filed on Mar. 17, 2011, now abandoned.

(30) Foreign Application Priority Data

Mar. 18, 2010 (JP) ..... 2010-062656

(51) Int. Cl.
*G03G 15/16* (2006.01)
*G03G 15/00* (2006.01)
*G03G 15/01* (2006.01)

(52) U.S. Cl.
CPC ..... *G03G 15/1665* (2013.01); *G03G 15/0131* (2013.01); *G03G 15/161* (2013.01);
(Continued)

(58) Field of Classification Search
CPC ..... G03G 15/6535; G03G 15/6532; G03G 2215/004; G03G 15/1665; G03G 15/0131; G03G 15/161; G03G 2215/0132
See application file for complete search history.

(56) References Cited

U.S. PATENT DOCUMENTS 4,979,000 A * 12/1990 Hamada ..... G03G 15/6535 361/235
5,384,590 A * 1/1995 Sugino ..... G03G 15/6535 347/140

(Continued)

FOREIGN PATENT DOCUMENTS

JP 01-154184 6/1989
JP 07-092821 4/1995

(Continued)

OTHER PUBLICATIONS

Office Action (Notification of Reason of Rejection) dated Sep. 4, 2012, issued in corresponding Japanese Patent Application No. 2010-062656, and an English Translation thereof. (6 pages).

(Continued)

*Primary Examiner* — Joseph S Wong
(74) *Attorney, Agent, or Firm* — Buchanan Ingersoll & Rooney PC

(57) ABSTRACT

An image forming apparatus has an image carrier that carries a toner image; a transfer member that is opposed to the image carrier, a transfer voltage being applied to the transfer member so that the toner image is transferred from the image carrier to a print medium passing between the transfer member and the image carrier; a first voltage application device that applies the transfer voltage to the transfer member; a separation member to which a separation voltage is applied so that the print medium is separated from the image carrier; a second voltage application device that applies the separation voltage to the separation member; a sensing device that senses an image density of the toner image; and a control section that controls a magnitude of the separation voltage based upon the image density of the toner image.

10 Claims, 9 Drawing Sheets

(52) U.S. Cl.
CPC ..... *G03G 15/6532* (2013.01); *G03G 15/6535* (2013.01); *G03G 2215/004* (2013.01); *G03G 2215/0132* (2013.01)

(56) References Cited

U.S. PATENT DOCUMENTS

| | | | |
|---|---|---|---|
| 5,697,030 | A | 12/1997 | Hayashi et al. |
| 6,173,150 | B1 | 1/2001 | Suzuki et al. |
| 2007/0147860 | A1 | 6/2007 | Furumizu et al. |

FOREIGN PATENT DOCUMENTS

| | | | |
|---|---|---|---|
| JP | 2000-293043 | A | 10/2000 |
| JP | 2003-167450 | A | 6/2003 |
| JP | 2003-323060 | A | 11/2003 |
| JP | 2007-121940 | A | 5/2007 |
| JP | 2007-140123 | A | 6/2007 |

OTHER PUBLICATIONS

Mikio Yamamoto et al., "Electrophotographic Color Printer Engine," OKI Technical Review, Aug. 1998, pp. 15-20, vol. 64. 6 pages.

* cited by examiner

IMAGE FORMING APPARATUS WITH CONTROLLED SEPARATION VOLTAGE AND TRANSFER VOLTAGE

This application is a divisional of U.S. patent application Ser. No. 13/050,037, filed on Mar. 17, 2011, which claims the priority of Japanese Patent Application No. 2010-062656 filed on Mar. 18, 2010, the contents of which are herein incorporated by reference.

BACKGROUND OF THE INVENTION

1. Field of the Invention

The present invention relates to an image forming apparatus, and particularly relates to an image forming apparatus that forms an image by means of toner.

2. Description of Related Art

Hereinafter, the structure of a conventional general image forming apparatus is described. FIG. 9 is a sectional constitutional view of the vicinity of a transfer roller 506 in a conventional image forming apparatus 500.

The image forming apparatus 500 includes an intermediate transfer belt 502, a driving roller 504, a transfer roller 506, and a separation member 508. The intermediate transfer belt 502 is wound around the driving roller 504. The driving roller 504 is rotated by a motor (not shown), whereby the intermediate transfer belt 502 is driven. The transfer roller 506 is provided so as to be opposed to the intermediate transfer belt 502.

In the image forming apparatus 500, a toner image formed on a photoreceptor (not shown) is transferred to the intermediate transfer belt 502 (primary transfer). Subsequently, the toner image transferred to the intermediate transfer belt 502 is transferred to paper passing between the intermediate transfer belt 502 and the transfer roller 506 (secondary transfer). The toner image is negatively charged. Further, the driving roller 504 is held at a ground potential, and the transfer roller 506 is held at a positive potential. The intermediate transfer belt 502 is held at a positive potential close to the ground potential. Under these conditions, the secondary transfer of the toner image is possible by an electric field generated between the intermediate transfer belt 502 and the transfer roller 506.

Incidentally, in the image forming apparatus 500, paper comes into contact with the transfer roller 506 held at the positive potential and therefore is positively charged. For this reason, the paper sticks to the intermediate transfer belt 502 through the electric field generated between the transfer roller 506 and the intermediate transfer belt 502. Thereat, in the image forming apparatus 500, the separation member 508 held at a negative potential is provided. Thereby, the paper is discharged by the separation member 508 and separated from the intermediate transfer belt 502.

However, there has been a problem with the image forming apparatus 500 in that the quality of the toner image deteriorates when the potential of the separation member 508 is lowered for reliable separation of the paper from the intermediate transfer belt 502. More specifically, when the potential of the separation member 508 is lowered, the potential difference between the transfer roller 506 and the separation member 508 increases, and therefore, a current flows from the transfer roller 506 to the separation member 508 via the paper. This causes a decrease in transfer current flowing from the transfer roller 506 to the intermediate transfer belt 502, thereby resulting inadequate transfer of the toner image. Thus, the quality of the toner image deteriorates.

It is to be noted that as a conventional image forming apparatus, there is known, for example, an image forming apparatus described in Japanese Patent Application Laid-Open No. 2003-167450. In this image forming apparatus, the time of applying a transfer bias voltage is adjusted so as to improve the paper separation property from a photosensitive drum. In the image forming apparatus described in Japanese Patent Application Laid-Open No. 2003-167450, any separation members like the separation member 508 are not used to separate paper from the photosensitive drum, and the above-described problem of deterioration in image quality does not occur.

SUMMARY OF THE INVENTION

An image forming apparatus according to an embodiment of the present invention comprises: an image carrier that carries a toner image; a transfer member that is opposed to the image carrier, a transfer voltage being applied to the transfer member so that the toner image is transferred from the image carrier to a print medium passing between the transfer member and the image carrier; a first voltage application device that applies the transfer voltage to the transfer member; a separation member to which a separation voltage is applied so that the print medium is separated from the image carrier; a second voltage application device that applies the separation voltage to the separation member; a sensing device that senses an image density of the toner image; and a control section that controls a magnitude of the separation voltage based upon the image density of the toner image.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Configuration of Image Forming Apparatus

Figure 1:
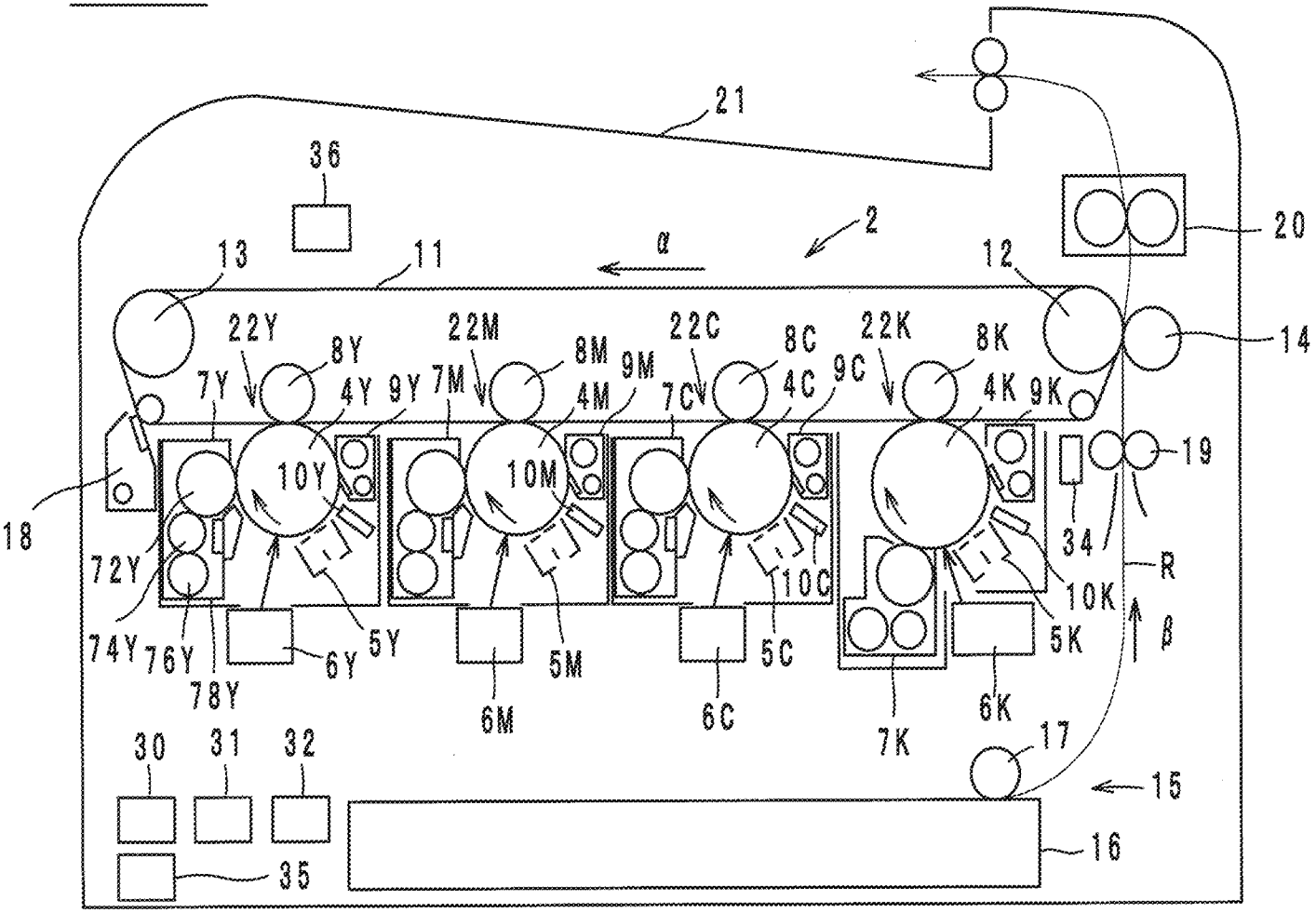
FIG. 1 is a view showing the overall structure of an image forming apparatus according to an embodiment of the present invention.
Figure 2:
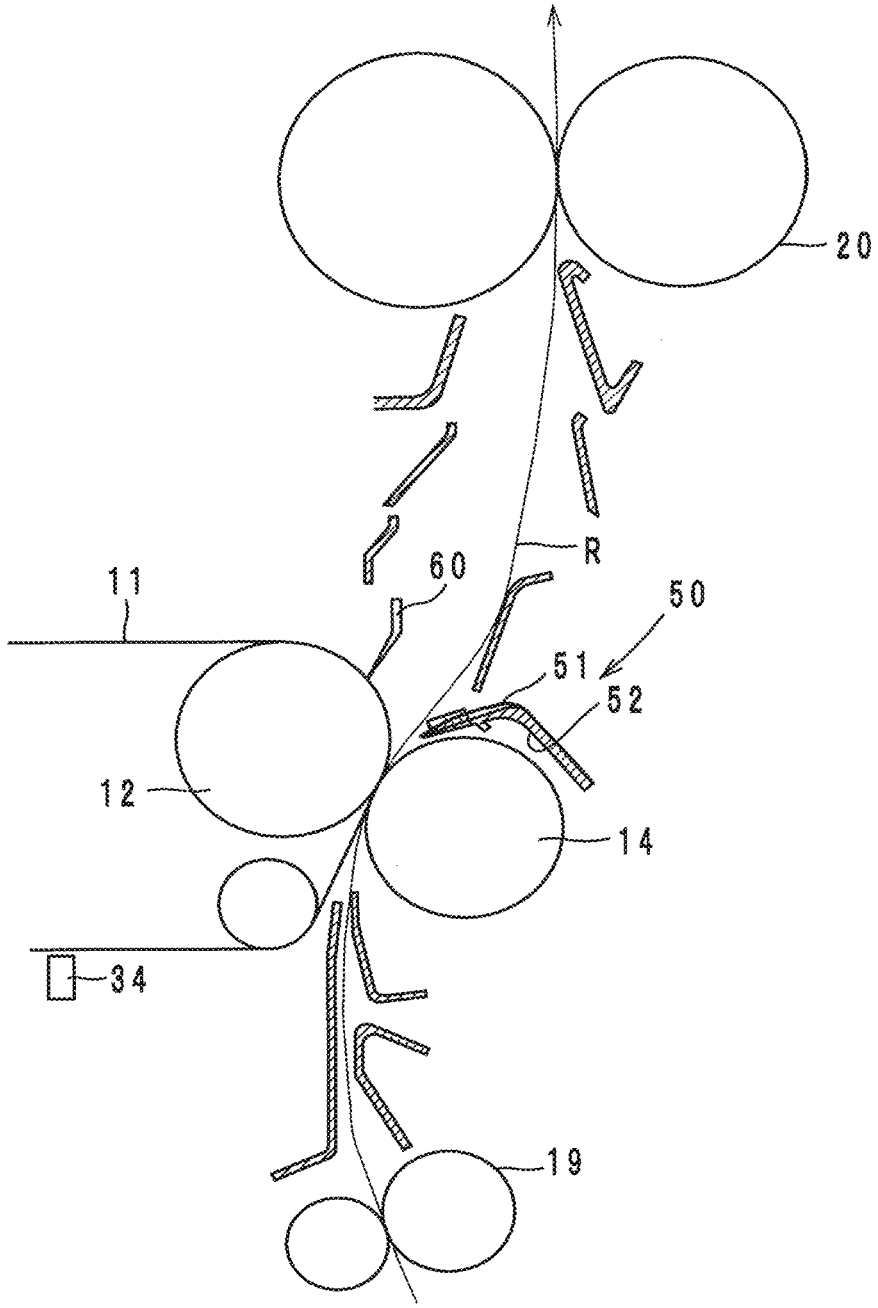
FIG. 2 is an enlarged view of a conveyance channel from a pair of timing rollers to a fixing unit.
Figure 3:
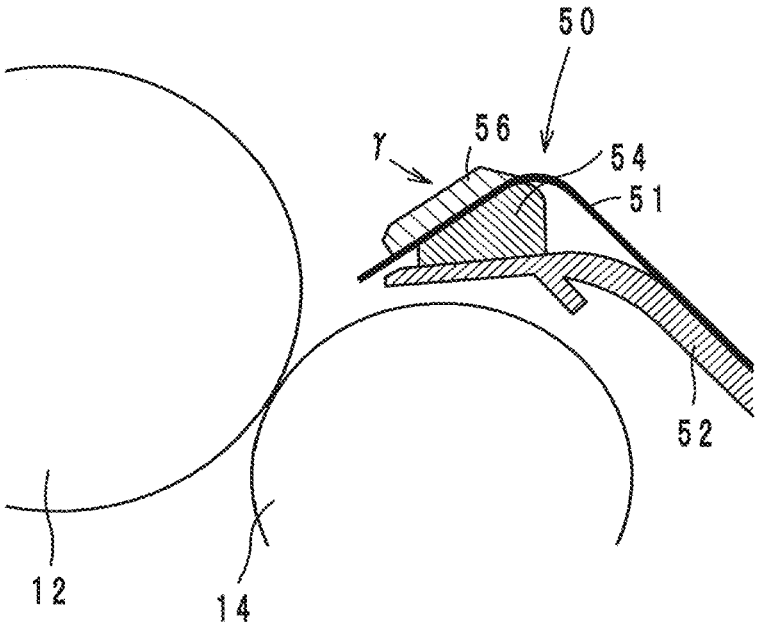
FIG. 3 is an enlarged view of the vicinity of a secondary transfer roller.

Hereinafter, an image forming apparatus according to an embodiment of the present invention is described with reference to the drawings. FIG. 1 shows the overall structure of an image forming apparatus 1 according to the embodiment of the present invention. FIG. 2 is an enlarged view of a conveyance channel R from a pair of timing rollers 19 to a fixing unit 20. FIG. 3 is an enlarged view of the vicinity of a secondary transfer roller 14.

An image forming apparatus 1 is an electrophotographic color printer of a tandem type, which is configured so as to synthesize an image of four colors of Y (yellow), M (magenta), C (cyan) and K (black). The image forming apparatus 1 has a function of forming an image on paper (print medium) based upon image data read by a scanner, and as shown in FIGS. 1 to 3, the image forming apparatus 1 includes a printing section 2, a paper feeding section 15, a timing roller couple 19, a fixing unit 20, a printed-paper tray 21, a control section 30, a voltage application sections 31, 32, a sensor (sensing device) 34, a memory 35, a touch panel 36, a separation section 50 (cf. FIGS. 2 and 3), and a separation claw 60 (cf. FIG. 2).

The paper feeding section 15 serves to feed paper P piece by piece, and includes a paper tray 16 and a paper feeding roller 17. A plurality of pieces of paper P to be subjected to printing are stacked and placed in the paper tray 16. The paper feeding roller 17 takes out the paper from the paper tray 16 piece by piece. The pair of timing rollers 19 conveys the paper P, while adjusting the timing so that a toner image can be transferred to the paper P in the printing section 2. It is to be noted that as shown in FIG. 1, the paper P is conveyed along the conveyance channel R in a direction of an arrow β. As shown in FIGS. 1 and 2, the conveyance channel R is made up of a plurality of guides.

The printing section 2 forms a toner image on the paper P fed from the paper feeding section 15. The printing section 2 includes: an image forming section 22 (22Y, 22M, 22C, 22K); a transfer section 8 (8Y, 8M, 8C, 8K); an intermediate transfer belt (image carrier) 11; a driving roller 12; a driven roller 13; a secondary transfer roller (transfer member) 14; and a cleaning unit 18. Further, the image forming section 22 (22Y, 22M, 22C, 22K) includes: a photosensitive drum 4 (4Y, 4M, 4C, 4K); a charger 5 (5Y, 5M, 5C, 5K); an exposure unit 6 (6Y, 6M, 6C, 6K); a development unit 7 (7Y, 7M, 7C, 7K); a cleaner 9 (9Y, 9M, 9C, 9K), and an eraser 10 (10Y, 10M, 10C, 10K).

The charger 5 charges the peripheral surface of the photosensitive drum 4. The exposure unit 6 applies laser by control of the control section 30. Thereby, an electrostatic latent image is formed on the peripheral surface of the photosensitive drum 4. That is, the charger 5 and the exposure unit 6 serve as an electrostatic latent image forming device for forming an electrostatic latent image on the peripheral surface of the photosensitive drum 4.

As shown in FIG. 1, the development unit 7 (7Y, 7M, 7C, 7K) includes a development roller 72 (72Y, 72M, 72C, 72K), a feeding roller 74 (74Y, 74M, 74C, 74K), a stirring roller 76 (76Y, 76M, 76C, 76K), and a housing section 78 (78Y, 78M, 78C, 78K). In FIG. 1, for the sake of simplicity of the drawing, only the development roller 72Y, the feeding roller 74Y, the stirring roller 76Y, and the housing section 78Y of the development unit 7Y are provided with reference numerals. The housing section 78 constitutes a body of the development unit 7, and houses the development roller 72, the feeding roller 74 and the stirring roller 76. Also, toner is stored in the housing section 78. The stirring roller 76 stirs the toner inside the housing section 78 to negatively charge the toner. The feeding roller 74 feeds the negatively charged toner to the development roller 72. The development roller 72 imparts the toner to the photosensitive drum 4. Specifically, a negative development bias voltage is applied to the development roller 72 so as to form a development field between the photosensitive drum 4 and the development roller 72. Since the toner is negatively charged, the toner moves from the development roller 72 to the photosensitive drum 4 under the influence of the development field. Further, the toner adheres to the photosensitive drum 4 based upon the electrostatic latent image formed on the photosensitive drum 4. In this way, the electrostatic latent image is developed into a toner image on the photosensitive drum 4.

The intermediate transfer belt 11 is extended between the driving roller 12 and the driven roller 13, and the toner image developed on the photosensitive drum 4 is transferred to the intermediate transfer belt 11 (primary transfer). The transfer section 8 is arranged so as to be opposed to the inner peripheral surface of the intermediate transfer belt 11. When a primary transfer voltage is applied to the transfer section 8, the toner image formed on the photosensitive drum 4 is transferred to the intermediate transfer belt 11. The cleaner 9 collects toner that remains on the peripheral surface of the photosensitive drum 4 after the primary transfer. The eraser 10 removes charge from the peripheral surface of the photosensitive drum 4. The driving roller 12 is rotated by an intermediate transfer belt driving section (not shown in FIG. 1) to drive the intermediate transfer belt 11 in a direction of an arrow α. In this manner, the intermediate transfer belt 11 conveys the toner image to the secondary transfer roller 14. Therefore, the intermediate transfer belt 11 functions as an image carrier for carrying and delivering a toner image. The sensor 34 is provided so as to be opposed to the intermediate transfer belt 11 on the upstream side from the secondary transfer roller 14 in a direction of an arrow α, and senses the density of the toner image.

The secondary transfer roller 14 is opposed to the intermediate transfer belt 11. When a transfer voltage is applied to the secondary transfer roller 14, the toner image is transferred from the intermediate transfer belt 11 to the paper P passing between the intermediate transfer belt 11 and the secondary transfer roller 14 (secondary transfer). More specifically, the driving roller 12 is held at a ground potential. Further, the intermediate transfer belt 11 is in contact with the driving roller 12, and thereby held at a positive potential close to the ground potential. The voltage application section 31 applies a positive transfer voltage to the secondary transfer roller 14 such that the potential of the secondary transfer roller 14 becomes higher than those of the driving roller 12 and the intermediate transfer belt 11. Since the toner image is negatively charged, the toner image is transferred from the intermediate transfer belt 11 to the paper P through the electric field generated between the driving roller 12 and the secondary transfer roller 14.

After the secondary transfer of the toner image to the paper P, the cleaning unit 18 removes toner that remains on the intermediate transfer belt 11.

The paper P with the toner image transferred thereto is conveyed to the fixing unit 20. The fixing unit 20 performs a heating treatment and a pressure treatment on the paper P to fix the toner image to the paper P. The printed paper P is placed in the printed-paper tray 21.

The separation section 50 is a separation member that separates the paper P from the intermediate transfer belt 11, and is provided in the conveyance channel R, at a position downstream from the intermediate transfer belt 11 and the secondary transfer roller 14 in the conveying direction, and on the opposite side of the conveyance channel R to the intermediate transfer belt 11, as shown in FIGS. 2 and 3. As shown in FIG. 3, the separation section 50 is made up of a separation member 51, a base 52, a spacer 54 and a protective member 56.

Figure 4:
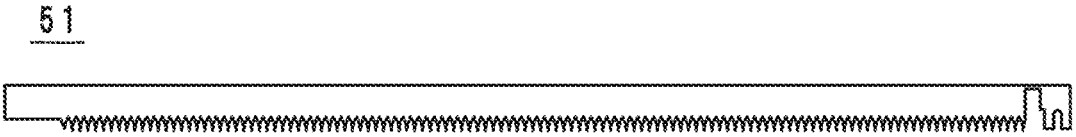
FIG. 4 is a plan view of a separation member seen from a direction of an arrow γ in FIG. 3.

The base 52 is bent into L shape in cross section, and is provided above the secondary transfer roller 14. The base 52 constitutes part of a body of the image forming apparatus 1, and is made of an insulating material. The separation member 51 is a metal plate of stainless or the like mounted on the upper surface of the base 52, and is bent into L shape in cross section, following the shape of the base 52. FIG. 4 is a plan view of the separation member 51 seen from a direction of an arrow γ in FIG. 3. As shown in FIG. 4, the separation member 51 has a sawtooth edge in its tip portion opposed to the conveyance channel R.

The spacer 54 is an insulating member provided between the base 52 and the separation member 51, and prevents the tip of the separation member 51 from coming into contact with the base 52. Thereby, the tip of the separation member 51 is prevented from being damaged. The protective member 56 is an insulating member provided on the top surface of the separation member 51, and protects the tip of the separation member 51.

A voltage application section 32 applies a voltage to the separation member 51 such that the potential of the intermediate transfer belt 11 becomes a value between the potential of the separation member 51 and the potential of the secondary transfer roller 14. Then, the paper P is separated from the intermediate transfer belt 11 by electrical force. More specifically, the driving roller 12 is held at the ground potential. Further, the intermediate transfer belt 11 is in contact with the driving roller 12, and thereby held at a positive potential close to the ground potential. The voltage application section 32 applies a negative separation voltage to the separation member 51 such that the potential of the separation member 51 becomes smaller than the potentials of the driving roller 12 and the intermediate transfer belt 11. The paper P is positively charged by contact with the secondary transfer roller 14. This causes discharge from the sawtooth edge of the separation member 51, thereby removing the charge of the paper P. Consequently, the paper P is separated from the intermediate transfer belt 11.

As shown in FIG. 2, the separation claw 60 is provided so as to be opposed to the intermediate transfer belt 11, at a position downstream from the portion where the intermediate transfer belt 11 and the secondary transfer roller 14 are opposed to each other in the driving direction of the intermediate transfer belt 11. If the paper P is wound around and conveyed by the intermediate transfer belt 11 without being separated by the separation section 50, the separation claw 60 separates the paper P from the intermediate transfer belt 11 by physical force.

The touch panel 36 is an input unit for receiving an input when a user touches the screen. The touch panel 36 also serves as an information receiving device for receiving information on the type (thin paper, ordinary paper or thick paper) of the paper P. Specifically, in the image forming apparatus 1, the touch panel 36 receives information on the thickness of the paper P as the information on the type of the paper P.

The control section 30 controls an overall operation of the image forming apparatus 1, and is realized by a CPU. Especially, in the image forming apparatus 1 according to the present embodiment, the control section 30 controls the magnitude of the separation voltage to be applied by the voltage application section 32 to the separation member 51, based upon the image density sensed by the sensor 34. Further, the control section 30 controls the magnitude of the transfer voltage to be applied by the voltage application section 31 to the secondary transfer roller 14, based upon the information on the type of the paper P received by the touch panel 36. Specifically, the memory 35 stores a table as shown by Table 1.

TABLE 1

| | Image Density | | | | | | | | |
|---|---|---|---|---|---|---|---|---|---|
| Separation Voltage (−V) | not less than 0% and less than 10% | not less than 10% and less than 20% | not less than 20% and less than 30% | not less than 30% and less than 40% | not less than 40% and less than 50% | not less than 50% and less than 60% | not less than 60% and less than 70% | not less than 70% and less than 80% | less than 80% |
| Thin Paper | 4000 | 3000 | 3000 | 2500 | 2500 | 2000 | 2000 | 1500 | 1000 |
| Ordinary Paper | 3000 | 2500 | 2500 | 2500 | 2000 | 2000 | 1500 | 1000 | 1000 |
| Thick Paper | 2500 | 2000 | 2000 | 1500 | 1000 | 1000 | 1000 | 1000 | 1000 |

Table 1 shows the relation among the image density, the type of the paper P and the separation voltage. As shown in Table 1, as the image density increases, the separation voltage shall be set smaller so that the difference between the potential of the intermediate transfer belt 11, which is close to the ground potential, and the potential of the separation member 51 will be smaller. Further, as the thickness of the paper P increases, the separation voltage shall be set smaller so that the difference between the potential of the intermediate transfer belt 11, which is close to the ground potential, and the potential of the separation member 51 will be smaller. The control of the magnitude of the separation voltage will be described in the following paragraphs. Hereinafter, that the separation voltage is "large" or "small" means that the absolute value (magnitude) of the separation voltage is large or small.

Tests

The present inventors performed two tests described below in order to decide a method for controlling the magnitude of the separation voltage. In the first test, using the image forming apparatus 1 shown in FIG. 1, a toner image with a relatively high image density (hereinafter referred to as a high-density image) and a toner image with a relatively low image density (hereinafter referred to as a low-density image) were formed on three types of paper P, which are thin paper, ordinary paper and thick paper, with different separation voltages (0 V, 1000 V, 2000 V and 3000 V) applied. Then, in each case, whether or not the paper P has been separated from the intermediate transfer belt 11 (hereinafter referred to as separation performance) was checked. Table 2 shows test results. In Table 2, ○ indicates that the paper P was separated without any difficulty, Δ indicates that the paper P was separated with such a little difficulty not to cause any practical problems, and × indicates that the paper P could not be separated.

TABLE 2

| Separation | Low-Density Image Separation Voltage (−V) | | | | High-Density Image Separation Voltage (−V) | | | |
|---|---|---|---|---|---|---|---|---|
| Performance | 0 | 1000 | 2000 | 3000 | 0 | 1000 | 2000 | 3000 |
| Thin Paper | x | x | x | ○ | x | x | Δ | ○ |
| Ordinary Paper | x | x | ○ | ○ | x | ○ | ○ | ○ |
| Thick Paper | ○ | ○ | ○ | ○ | ○ | ○ | ○ | ○ |

As shown in Table 2, it was found that a larger separation voltage is required when the thickness of the paper P becomes smaller. It is, therefore, desired that the separation voltage is controlled to become larger with decreases in thickness of the paper P, as shown in Table 1.

Moreover, in forming the high-density image, satisfactory separation performance of the paper P was ensured even with a smaller separation voltage than in forming the low-density image. The reason is as follows. The paper P with the high-density image formed thereon sticks to the intermediate transfer belt 11 with weaker force than the paper P with the low-density image formed thereon because a larger amount of toner is present between the paper P with the high-density image formed thereon and the intermediate transfer belt 11 than between the paper P with the lower-density image formed thereon and the intermediate transfer belt 11. It is, therefore, desired that the separation voltage is controlled to become smaller with increases in image density, as shown in Table 1.

In the second test, using the image forming apparatus 1 shown in FIG. 1, a toner image with a relatively high image density (hereinafter referred to as a high-density image) and a toner image with a relatively low image density (hereinafter referred to as a low-density image) were formed on three types of paper P, which are thin paper, ordinary paper and thick paper, with different separation voltages (0 V, 1000 V, 2000 V and 3000 V) applied. Then, in each case, whether or not the toner image has been transferred to the paper P satisfactorily (hereinafter referred to as transfer performance) was checked. Table 3 is shows test results. In Table 3, ○ indicates that the toner image was transferred satisfactorily, and × indicates that satisfactory toner image transfer could not be done.

TABLE 3

| Transfer | Low-Density Image Separation Voltage (−V) | | | | High-Density Image Separation Voltage (−V) | | | |
|---|---|---|---|---|---|---|---|---|
| Performance | 0 | 1000 | 2000 | 3000 | 0 | 1000 | 2000 | 3000 |
| Thin Paper | ○ | ○ | ○ | ○ | ○ | ○ | ○ | x |
| Ordinary Paper | ○ | ○ | ○ | ○ | ○ | ○ | ○ | x |
| Thick Paper | ○ | ○ | ○ | ○ | ○ | ○ | x | x |

As shown in Table 3, in forming the low-density image, satisfactory transfer performance could be achieved under every condition. On the other hand, in forming the high-density image, satisfactory transfer performance could not be obtained when the separation voltage was large. The fails in transfer are due to a current flow from the secondary transfer roller 14 to the separation member 51 that occurs when the separation voltage is large. It was found from the second test that a large separation voltage cannot be applied in the cases of forming the high-density image. Accordingly, also from the viewpoint of the transfer performance, it is desired that the separation voltage is controlled to become smaller with increases in image density of the toner image, as shown in Table 1.

Operation of Image Forming Apparatus

Figure 5:
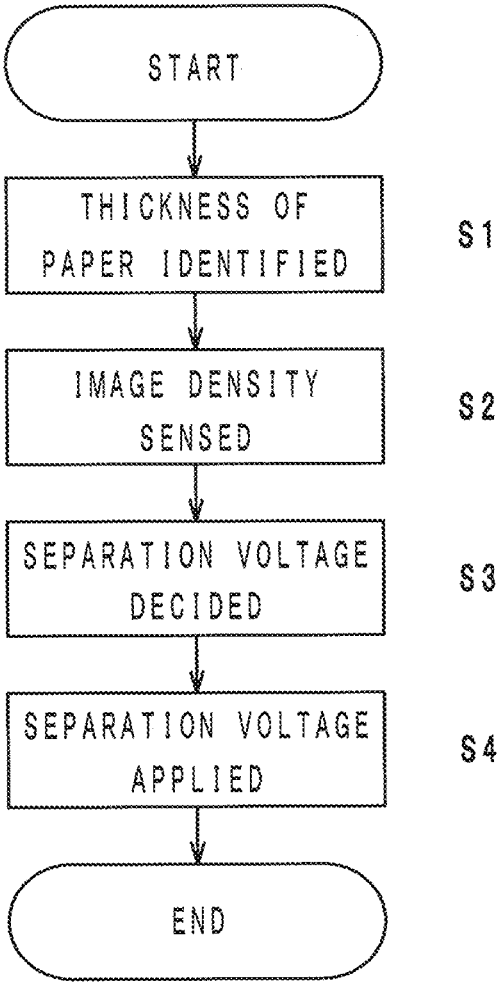
FIG. 5 is a flowchart showing an operation performed by a control section for transfer of a toner image to paper.

Hereinafter, the operation of the image forming apparatus 1 configured as above is described with reference to the drawings. FIG. 5 is a flowchart showing an operation performed by the control section 30 for transfer of a toner image to the paper P.

The present process is started when the user issues a printing instruction with the touch panel 36. The control section 30 obtains information on the type of the paper P, which is inputted on the touch panel 36, to identify the thickness of the paper P (step S1). Next, the control section 30 makes the printing section 2 form a toner image.

Next, the control section 30 makes the sensor 34 sense the image density of the toner image transferred to the intermediate transfer belt 11 (step S2). The control section 30 then decides a separation voltage referring to Table 1, based upon the thickness of the paper P identified at step S1 and the image density sensed at step S2 (step S3).

Next, the control section 30 makes the paper feeding section 15 and the pair of timing rollers 19 convey the paper P to the secondary transfer roller 14 for secondary transfer of the toner image to the paper P, while making the voltage application section 32 apply the separation voltage to the separation member 51 (step S4). Thereby, even if the paper P is positively charged, the charge of the paper P is removed in the separation member 51 while the paper P is passing between the secondary transfer roller 14 and the intermediate transfer belt 11. As a result, the paper P is separated from the intermediate transfer belt 11 and conveyed to the fixing unit 20. Subsequently, the fixing unit 20 performs a heating treatment and a pressure treatment on the paper P to fix the toner image to the paper P. The paper P is then ejected onto the printed-paper tray 21.

Effect

In the image forming apparatus 1 configured as above, it is possible to reliably separate the paper P from the intermediate transfer belt 11 without causing deterioration in image quality. More specifically, as shown in Table 3, when the image density of the toner image becomes higher, deterioration in transfer performance is apt to occur due to a current flow from the secondary transfer roller 14 to the separation member 51, and accordingly, deterioration in image quality is apt to occur. On the other hand, as shown in Table 2, when the image density of the toner image becomes higher, satisfactory separation performance can be achieved even with a small separation voltage. Therefore, in the image forming apparatus 1, the separation voltage is controlled to become smaller with increases in image density of the toner image, as shown in Table 1. Accordingly, when the image density of the toner image is low, which means that the paper P is difficult to separate from the intermediate transfer belt, a relatively high separation voltage is used to separate the paper P. Further, when the image density of the toner image is high, a current is apt to flow from the secondary transfer roller 14 to the separation member 51, and it is thereby possible to separate the paper P by use of a relatively low separation voltage. Thus, according to the image forming apparatus 1, it is possible to reliably separate the paper P from the intermediate transfer belt 11 without causing deterioration in image quality.

Further, as is apparent from Table 2, a larger separation voltage is required as the thickness of the paper P becomes smaller. This is because a thinner paper P is more apt to be wound around the intermediate transfer belt 11. Therefore, in the image forming apparatus 1, the separation voltage is controlled to become larger with decreases in thickness of the paper P, as shown in Table 1. This allows reliable separation of the paper P from the intermediate transfer belt 11.

First Modification

Hereinafter, an image forming apparatus 1*a* according to a first modification is described. In the image forming apparatus 1, the control section 30 makes the voltage application section 31 apply a transfer voltage with a constant magnitude to the secondary transfer roller 14. On the other hand, in the image forming apparatus 1*a*, the control section 30 changes the magnitude of the transfer voltage based upon the magnitude of the separation voltage. Specifically, the memory 35 stores a table shown in Table 4.

TABLE 4

| Transfer | Separation Voltage (−V) | | | | |
|---|---|---|---|---|---|
| Voltage (V) | 1000 | 1500 | 2000 | 2500 | 3000 |
| Thin Paper | 1800 | 1850 | 1950 | 2100 | 2300 |
| Ordinary Paper | 1900 | 2000 | 2100 | 2300 | 2500 |
| Thick Paper | 2100 | 2200 | 2300 | 2500 | 2800 |

Figure 6:
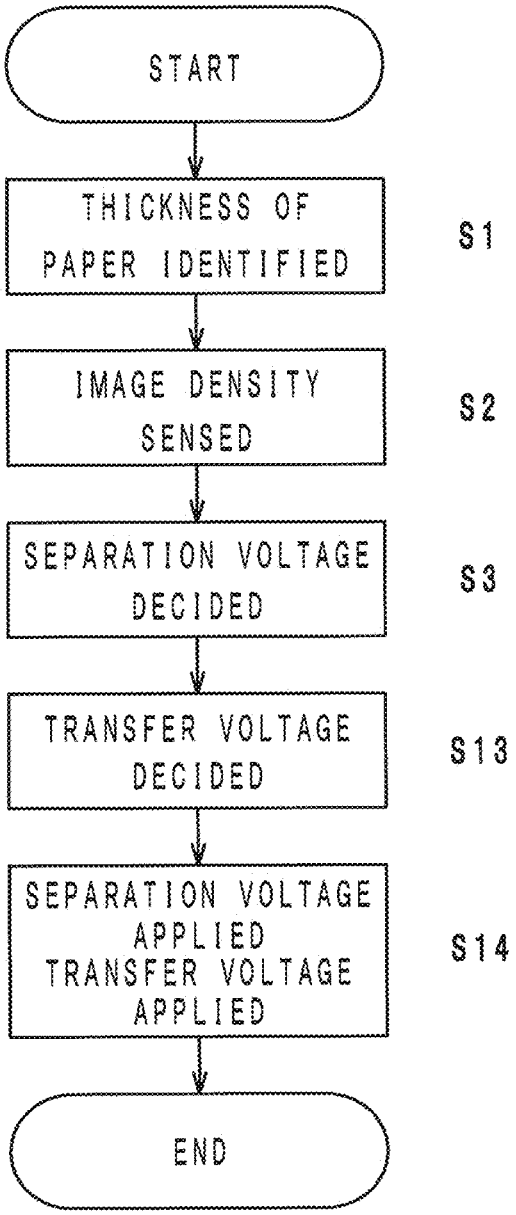
FIG. 6 is a flowchart showing an operation performed by the control section of the image forming apparatus according to a first modification for transfer of a toner image to paper.

Table 4 shows the relation among the type of the paper P, the separation voltage and the transfer voltage to achieve satisfactory transfer. As shown in Table 4, the transfer voltage shall be larger with increases in separation voltage. In other words, the larger the difference between the potential of the intermediate transfer belt 11, which is close to the ground potential, and the potential of the separation member 51 is, the larger the potential difference between the intermediate transfer belt 11 and the secondary transfer roller 14 shall be. Further, the transfer voltage shall be larger with increases in thickness of the paper P. In other words, the larger the thickness of the paper P is, the larger the potential difference between the intermediate transfer belt 11 and the separation member 51 shall be. According to the first modification, therefore, the control section 30 further controls the transfer voltage based upon the thickness of the paper P and the separation voltage. Hereinafter, the operation of the image forming apparatus 1*a* is described with reference to the drawings. FIG. 6 is a flowchart showing an operation performed by the control section 30 of the image forming apparatus 1*a* for transfer of a toner image to the paper P.

Since steps S1 to S3 in FIG. 6 are the same as steps S1 to S3 in FIG. 5, the descriptions thereof are not given. At step S13, the control section 30 decides a transfer voltage referring to Table 4, based upon the thickness of the paper P identified at step S1 and the separation voltage decided at step S3 (step S13). Subsequently, the process goes to step S14.

Next, the control section 30 makes the voltage application section 31 apply the transfer voltage to the secondary transfer roller 14 and makes the paper feeding section 15 and the pair of timing rollers 19 convey the paper P to the secondary transfer roller 14 so that a toner image is transferred to the paper P, while making the voltage application section 32 apply the separation voltage to the separation member 51 (step S14). Subsequently, the fixing unit 20 performs a heating treatment and a pressure treatment on the paper P to fix the toner image to the paper P. The paper P is then ejected onto the printed-paper tray 21.

The image forming apparatus 1*a* has improved transfer performance. More specifically, as shown in Table 3, when the separation voltage becomes higher, the transfer voltage becomes insufficient, which may result in a decrease in transfer performance. In the image forming apparatus 1*a*, therefore, the transfer voltage is controlled to become larger with increases in separation voltage. This inhibits a decrease in transfer performance due to insufficient transfer voltage when the separation voltage is large.

Second Modification

Figure 7:
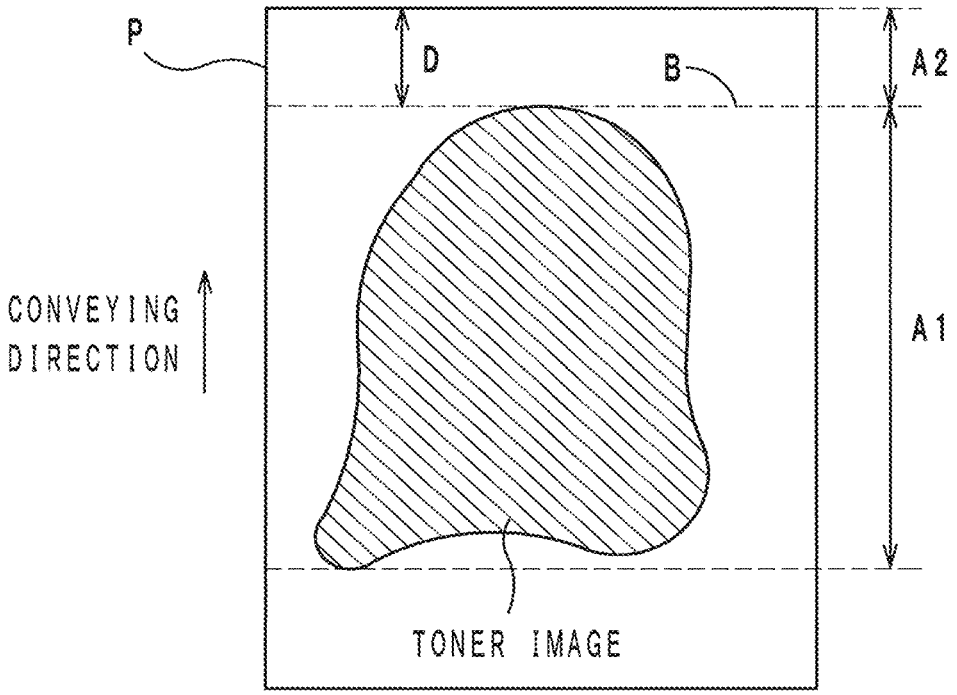
FIG. 7 is a plan view of paper.

Hereinafter, an image forming apparatus 1*b* according to a second modification is described. In the image forming apparatus 1, the control section 30 holds the separation voltage constant while one piece of paper P is passing between the intermediate transfer belt 11 and the secondary transfer roller 14. On the other hand, in the image forming apparatus 1*b*, the control section 30 changes the separation voltage while one piece of paper P is passing between the intermediate transfer belt 11 and the secondary transfer roller 14. FIG. 7 is a plan view of the paper P.

Figure 8:
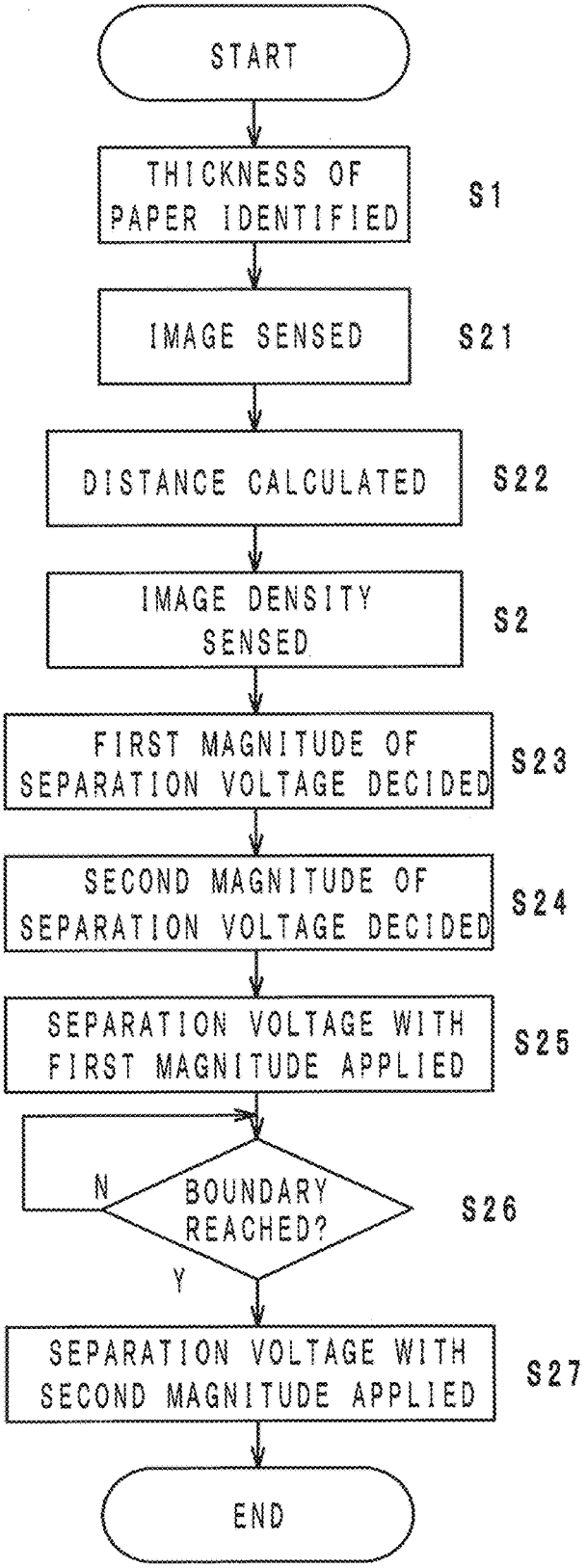
FIG. 8 is a flowchart showing an operation performed by the control section of the image forming apparatus according to a second modification for transfer of a toner image to paper.
Figure 9:
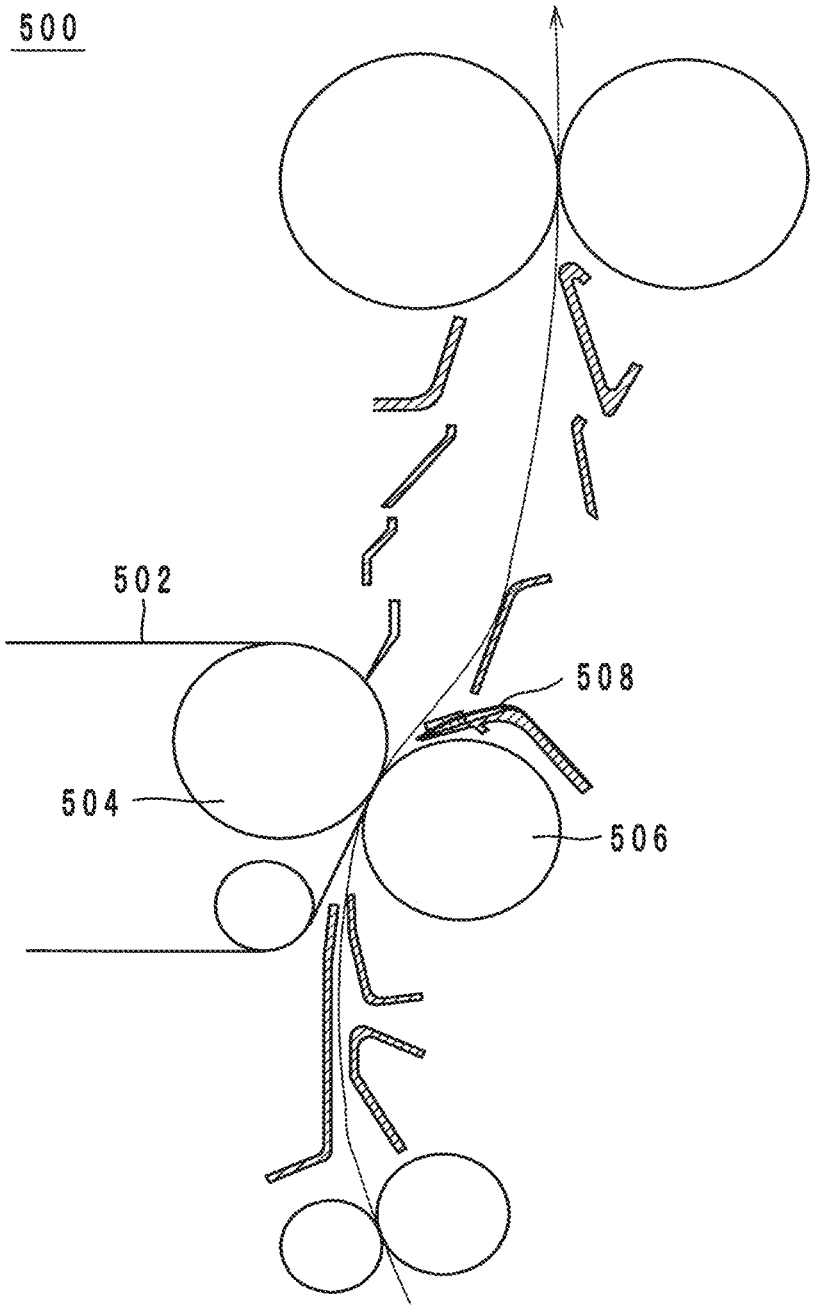
FIG. 9 is a sectional view of the vicinity of a transfer roller in a conventional image forming apparatus.

A toner image is formed on the paper P shown in FIG. 7. An area where the toner image is formed is defined as an area A1, and an area in the leading portion in a conveying direction ahead of the area A1 is defined as an area A2. The toner image is not formed in the area A2. Further, a boundary between the area A1 and the area A2 is defined as a boundary B. With respect to the area A1 where a toner image is formed, it is possible to separate the paper P from the intermediate transfer belt 11 even with a relatively low separation voltage. On the other hand, in the area A2 where no toner image is formed, a relatively high separation voltage is required to separate the paper P from the intermediate transfer belt 11. In the image forming apparatus 1*b*, therefore, the control section 30 controls the separation voltage to have different magnitudes between while the area A2 is passing by the separation member 51 and while the area A1 is passing by the separation member 51. Assuming the magnitude of the separation voltage applied to the separation member 51 while the area A2 is passing by the separation member 51 as a first magnitude and assuming the magnitude of the separation voltage applied to the separation member 51 while the are A1 is passing by the separation member 51 as a second magnitude, the control section 30 controls the separation voltage such that the second magnitude is smaller then the first magnitude. In other words, the potential difference between the intermediate transfer belt 11 and the separation member 51 while the area A1 is passing by the separation member 51 is made smaller than the potential difference between the intermediate transfer belt 11 and the separation member 51 while the area A2 is passing by the separation member 51. Hereinafter, the operation of the image forming apparatus 1*b* is described with reference to the drawings. FIG. 8 is a flowchart showing an operation performed by the control section 30 of the image forming apparatus 1*b* for transfer of a toner image to the paper P.

Since step S1 in FIG. 8 is the same as step S1 in FIG. 5, the description thereof is not given. At step S21, the control section 30 identifies the leading edge of the toner image in the conveying direction when the control section 30 senses that the image density has increased from 0% for the first time since the start of sensing (step S21). Next, the control section 30 calculates a distance D of the boundary B between the area A1 and the area A2 from the leading edge of the paper P, based upon the time of sensing the leading edge of the toner image (step S22). Subsequently, the process goes to step S2. Since step S2 in FIG. 8 is the same as step S2 in FIG. 5, the description thereof is not given.

At step S23, the control section 30 decides the first magnitude of the separation voltage referring to Table 1, based upon the thickness of the paper P identified at step S1 (step S23). It is to be noted that the image density that is a factor of the decision of the first magnitude of the separation voltage is not less than 0% and less than 10%.

Next, the control section 30 decides the second magnitude of the separation voltage referring to Table 1, based upon the thickness of the paper P identified at step S1 and the image density sensed at step 2 (step S24).

Next, the control section 30 makes the paper feeding section 15 and the pair of timing rollers 19 convey the paper P to the secondary transfer roller 14 so as to start secondary transfer of the toner image to the paper P, while making the voltage application section 32 apply the separation voltage with the first magnitude to the separation member 51 (step S25).

Next, the control section 30 determines whether or not the boundary B has reached the separation member 51 (step S26). The determination in step S26 is performed, for example, based upon the distance D calculated at step S22 and a distance that the pair of timing rollers 19 conveyed the paper P. When the boundary B has not reached the separation member 51, the process returns to step S26. On the other hand, when the boundary B has reached the separation member 51, the process goes to step S27.

When the boundary B has reached the separation member 51, the control section 30 makes the voltage application section 32 apply the separation voltage with the second magnitude to the separation member 51 (step S27). Subsequently, the fixing unit 20 performs a heating treatment and a pressure treatment on the paper P to fix the toner image to the paper P. The paper P is then ejected onto the printed-paper tray 21.

In the image forming apparatus 1*b*, it is possible to separate the paper P from the intermediate transfer belt 11 more reliably without causing deterioration in image quality. More specifically, in the area A1 where the toner image is formed, the paper P can be separated from the intermediate transfer belt 11 with a smaller separation voltage as compared with the area A2 where the toner image is not formed. On the other hand, since the toner image is formed in the area A2, a current is apt to flow from the secondary transfer roller 14 to the separation member 51 as compared with the area A1. Therefore, in the image forming apparatus 1*b*, the separation voltage applied while the area A1 is passing by the separation member 51 has a smaller magnitude than that while the area A2 is passing by the separation member 51. Thereby, high separation performance can be achieved in the area A2 while high transfer performance can be achieved in the area A1.

It should be noted that in the image forming apparatus 1, 1*a*, 1*b*, the transfer section 8 may be a roller.

The image forming apparatuses 1, 1*a* and 1*b* may be of a type wherein the toner image is directly transferred from the photosensitive drum 4 to the paper P not via the intermediate transfer belt 11. In this case, the photosensitive drum 4 functions as the image carrier.

Further, although the separation voltage is decided referring to Table 1 in the image forming apparatuses 1, 1*a* and 1*b*, the separation voltage may be, for example, calculated by use of equation (1) shown below.

$$V=3000-a\times b \quad (1)$$

V: separation voltage (−V)

a: constant b: image density (%)

In the image forming apparatuses 1, 1*a* and 1*b*, the separation voltage is decided also based upon the thickness of the paper P. However, in the image forming apparatuses 1, 1*a* and 1*b*, the separation voltage may be decided based upon the temperature, the humidity or the resistance value of the paper P, in addition to the thickness of the paper P.

The separation member 51 may have an edge with needles, a brush edge or the like, other than the sawtooth edge shown in FIG. 4. Further, the separation member 51 may be made of a conductive cloth.

In the image forming apparatuses according to the embodiments, it is possible to reliably separate a print medium from an image carrier without causing deterioration in image quality.

Although the present invention has been described in connection with the preferred embodiments, it is to be noted that various changes and modifications are possible to those who are skilled in the art. Such changes and modifications are to be understood as being within the scope of the present invention.

What is claimed is:

1. An image forming apparatus comprising:

an image carrier that carries a toner image;

a transfer member that is opposed to the image carrier;

a hardware processor configured to determine a magnitude of a transfer voltage to be applied to the transfer member so that the toner image is transferred from the image carrier to a print medium passing between the transfer member and the image carrier;

a first voltage application device that applies the transfer voltage to the transfer member;

a separation member to which a separation voltage is applied so that the print medium is separated from the image carrier;

a second voltage application device that applies the separation voltage to the separation member;

a sensing device that senses an image density of the toner image;

wherein the hardware processor controls a magnitude of the separation voltage based upon the image density of the toner image and the hardware processor further controls the magnitude of the transfer voltage based on the magnitude of the separation voltage, and wherein the hardware processor controls the magnitude of the transfer voltage such that the larger the potential difference between the image carrier and the separation member is, the larger the potential difference between the image carrier and the transfer member is.

2. The image forming apparatus according to claim 1, wherein the hardware processor further controls the magnitude of the separation voltage such that a potential difference between the image carrier and the separation member while a first area of the print medium is passing by the separation member is smaller than the potential difference between the image carrier and the separation member while a second area of the print medium is passing by the separation member, the first area being an area where the toner image is formed, and the second area being a leading portion in a print medium conveying direction ahead of the first area.

3. The image forming apparatus according to claim 1, wherein the separation voltage and the transfer voltage have such magnitudes that a potential of the image carrier becomes a value between a potential of the separation member and a potential of the transfer member.

4. The image forming apparatus according to claim 1, wherein the hardware processor controls the magnitude of the separation voltage such that the higher the image density of the toner image is, the smaller the potential difference between the image carrier and the separation member is.

5. The image forming apparatus according to claim 1, further comprising an information receiving device that receives information on a type of the print medium, wherein the hardware processor also controls the magnitude of the separation voltage based upon the type of the print medium.

6. The image forming apparatus according to claim 5, wherein the information receiving device receives information on a thickness of the print medium as the information on the type of the print medium, and the hardware processor controls the magnitude of the separation voltage based upon the thickness of the print medium.

7. The image forming apparatus according to claim 6, wherein the hardware processor controls the magnitude of the separation voltage such that the larger the thickness of the print medium is, the smaller the potential difference between the image carrier and the separation member is.

8. The image forming apparatus according to claim 5, wherein the information receiving device is an input unit for receiving an input from a user.

9. The image forming apparatus according to claim 1, further comprising a photoreceptor on which the toner image is formed, wherein the image carrier is an intermediate transfer member to which the toner image developed on the photoreceptor is transferred.

10. An image forming apparatus comprising:

an image carrier that carries a toner image;

a transfer member that is opposed to the image carrier;

a hardware processor configured to determine a magnitude of a transfer voltage to be applied to the transfer member so that the toner image is transferred from the image carrier to a print medium passing between the transfer member and the image carrier;

a first voltage application device that applies the transfer voltage to the transfer member;

a separation member to which a separation voltage is applied so that the print medium is separated from the image carrier;

a second voltage application device that applies the separation voltage to the separation member; and a sensing device that senses an image density of the toner image;

wherein the hardware processor controls a magnitude of the separation voltage based upon the image density of the toner image, and the hardware processor further controls a magnitude of the separation voltage such that a potential difference between the image carrier and the separation member while a first area of the print medium is passing by the separation member is smaller than the potential difference between the image carrier and the separation member while a second area of the print medium is passing by the separation member, the first area being an area where the toner image is formed, and the second area being a leading portion in a print medium conveying direction ahead of the first area.

* * * * *